US010952921B1

(12) United States Patent
Kesner et al.

(10) Patent No.: US 10,952,921 B1
(45) Date of Patent: Mar. 23, 2021

(54) MASSAGE DEVICE

(71) Applicant: Vibration Cane, LLC, Phoenix, AZ (US)

(72) Inventors: Charles Edward Kesner, Mesa, AZ (US); Tyler Douglas Comer, Phoenix, AZ (US); Jennifer Jo Kesner, Mesa, AZ (US); Daniel Wright Allen, Mesa, AZ (US); George Carl Dierking, Tempe, AZ (US); Joseph Elijio Velasquez, Fountain Hills, AZ (US)

(73) Assignee: Vibration Cane, LLC, Overgaard, AZ (US)

( * ) Notice: Subject to any disclaimer, the term of this patent is extended or adjusted under 35 U.S.C. 154(b) by 15 days.

(21) Appl. No.: 16/502,104

(22) Filed: Jul. 3, 2019

Related U.S. Application Data

(60) Provisional application No. 62/693,567, filed on Jul. 3, 2018.

(51) Int. Cl.
*A61H 15/00* (2006.01)
*A61H 23/02* (2006.01)

(52) U.S. Cl.
CPC ..... *A61H 15/0085* (2013.01); *A61H 23/02* (2013.01); *A61H 2201/0153* (2013.01); *A61H 2201/169* (2013.01)

(58) Field of Classification Search
CPC ..... A61H 1/008; A61H 7/002; A61H 7/003; A61H 7/005; A61H 7/007; A61H 7/008; A61H 15/00; A61H 15/0085; A61H 2015/0007; A61H 2015/0042; A61H 2015/0085; A61H 2015/0071; A61H 2015/0092; A61H 23/0254; A61H 23/02; A61H 2201/0107; A61H 2201/0153; A61H 2201/0157; A61H 2201/1253; A61H 2201/0119; A61H 2201/1269; A61H 2201/1276; A61H 2201/1635;
(Continued)

(56) References Cited

U.S. PATENT DOCUMENTS 3,451,391 A * 6/1969 Tavel ..... A61H 19/44 601/72
4,224,932 A * 9/1980 Farb ..... A61H 23/0263 601/72

(Continued)

*Primary Examiner* — Tu A Vo
*Assistant Examiner* — Alexander Morales
(74) *Attorney, Agent, or Firm* — Invention To Patent Services; Alex Hobson

(57) ABSTRACT

A massage device has a position adjustable handle along a handle slot that extends along a portion of the cane support. The cane support has a support extension portion, or the long substantially linear portion, an arc portion that extends from the support extension in an arc or cure and a head portion. The handle slot may extend a portion of the length of the cane support and along the support extension to the head portion. A vibration device is coupled to the head end of the cane support and may be decoupled from the cane support by a vibration dampening material that extends around the vibration device within a chamber. The vibration dampening material extend out to form a locking ring between the vibration assembly and the massage head. A user can comfortably hold the massage head against their body without excessive vibration in the cane support or handle.

16 Claims, 6 Drawing Sheets

(58) Field of Classification Search
CPC .... A61H 2201/1654; A61H 2201/1657; A61H 2201/164; A61H 2201/1664; A61H 2201/1671; A61H 2201/1673; A61H 2201/1685; A61H 2201/169; A61H 2205/06; A61H 2205/10; A63B 60/00; A63B 6/06; A63B 6/14; A63B 6/22–34; A63B 2023/006; A63B 22/00; A63B 22/0002; A63B 22/0005; A63B 53/14; A63B 21/40; A63B 21/4017; A63B 21/4021; A63B 21/4027; A63B 21/4033–4035; A63B 21/4041
See application file for complete search history.

(56) References Cited

U.S. PATENT DOCUMENTS 4,590,814 A 5/1986 Wadensten
5,193,528 A * 3/1993 Iwamoto ..... A61H 23/0263 601/72
5,471,695 A 12/1995 Aiyar
5,725,422 A 3/1998 Leweck
6,261,251 B1 7/2001 Meyers
6,478,755 B2 11/2002 Young
6,758,826 B2 * 7/2004 Luettgen ..... A61H 19/34 601/135
7,335,171 B2 2/2008 Ewell et al.
7,540,847 B2 6/2009 Klein et al.
9,050,240 B2 6/2015 Howsam
9,441,759 B1 9/2016 Bley
9,717,643 B2 8/2017 Guang
2006/0116614 A1 * 6/2006 Jones ..... A61H 23/0263 601/80
2007/0000531 A1 * 1/2007 Russo ..... A61H 3/02 135/66
2011/0179603 A1 7/2011 Edelen
2011/0230800 A1 * 9/2011 Binns ..... A61H 1/0281 601/5
2013/0123674 A1 5/2013 Carter et al.
2015/0374578 A1 * 12/2015 Matsuura ..... A61H 23/02 601/46
2016/0058656 A1 * 3/2016 Harvel ..... A61H 15/0092 601/122
2016/0136032 A1 * 5/2016 Dakides ..... A61H 7/007 601/113
2017/0209248 A1 7/2017 Sorrentino
2019/0111557 A1 * 4/2019 Kemp ..... A47K 7/022

* cited by examiner

MASSAGE DEVICE

CROSS-REFERENCE TO RELATED APPLICATIONS

This application claims the benefit of priority to U.S. provisional patent No. 62/693,567, filed on Jul. 3, 2018; the entirety of which is hereby incorporated by reference herein.

BACKGROUND OF THE INVENTION

Field of the Invention

This invention is directed to massage devices having a slender extension and a curved end and particularly to a massage device with an adjustable position handle and a vibration device that is decoupled from the cane support.

Background

Massage devices and those generally shaped like canes enable locating a vibrating massage device in hard to reach places, such as on the back or back of the neck to relieve pain. The massage head may be placed and pressed on an affected portion of the body to relieve pain. Some areas of the body are hard to reach or create an awkward holding arrangement that is not conducive to providing adequate pressure. Some massage devices have handles that extend out from the cane support but they are in locations that interfere with locating the massage head against the body or are not in a desired position for the user to provide adequate pressure.

SUMMARY OF THE INVENTION

The invention is directed to a massage device having an adjustable handle and a vibration device that is isolated from the cane support by a vibration dampening material, such as an elastomeric material. An exemplary adjustable handle extends out orthogonally from the cane support and may be slid along a length of the cane support and fixed in a desired location to enable the user to locate the massage head against a desired area and use the adjustable handle to apply pressure and/or hold the cane in position. The adjustable handle may be slid over a portion of the support extension of the cane support and in some cases along a portion of the arc portion of the cane support. An exemplary vibration device may be detachably attached to the cane support and is configured within a vibration chamber having a vibration dampening material, such as an elastomeric material or an elastomer, configured around the vibration device.

An exemplary massage device comprises a cane support extending from a base end to a head end. The cane support can be described by different sections or portions including: a support extension that extends substantially linearly from the base end to the beginning of the arc portion; an arc portion that is coupled with the support extension and extends, in an arc or curve, to the head portion. A cane support may extend from a controller portion coupled to the cane support to form a handle at the base end. The support extension portion of the cane support may have a length of about 10 Inches or more, about 12 inches or more, about 16 inches or more and any range between and including the length values provided. The arc portion may extend from the support extension about 90 degrees or more about an arc, about 120 degrees or more about an arc, about 160 degrees or more about an arc, or about 180 degrees, such as at least 170 degrees. The arc portion extends from the support extension to the head end. An arc portion may have an arc diameter of about six inches or more, about eight inches or more, about 10 inches or more, about 12 inches or more and any range between and including the diameter values provided. The head portion is the portion of the cane support that is proximal to the massage head or the vibration device or opposite the base end. The can support may be made of metal, such as aluminum, to provide a substantial amount of mechanical strength and may have a hollow extension that extends along the length of the cane support to reduce the weight. When a massage can is large in dimension it can flex and break when made out of plastic and this is not desirable. A hollow extension or channel may extend the entire length of the cane support. A hollow cane support may be an effective heat sink for the heat generated by the vibrating device. The heat may be transferred through to the cane support directly or through an elastomeric material configured around the vibrating device. A hollow cane support will have a larger surface area for dissipation of heat.

An exemplary massage device of the present invention comprises an adjustable handle that can be moved along the cane support along a handle slot that extends at least a portion of the length of the support extension and may extend at least a portion around the arc portion. In an exemplary embodiment, the handle slot extends a substantial portion of the length of the support portion, or about 50% of the length or more, about 75% of the length or more, about 90% of the length or more and any range between and including the values provided. In an exemplary embodiment the handle slot extends a substantial portion of the length of the arc portion, or about 50% of the length or more, about 75% of the length or more, about 90% of the length or more and any range between and including the values provided. In an exemplary embodiment, the handle slot extends from the support extension along the entire arc portion to the head portion, or where the cane support is substantially parallel with the support extension length. In an exemplary embodiment, the handle slot extends a substantial portion of the length of the cane support as measured from the base to the head end, or about 50% of the length or more, about 75% of the length or more, about 90% of the length or more and any range between and including the values provided.

An exemplary adjustable handle is coupled to the cane support by a coupling, such as a threaded coupling, wherein threads on the adjustable handle engage with threads of a handle-guide to secure the adjustable handle to the cane support in a fixed location. An exemplary handle-guide is configured in a guide-channel that extends within the cane support and along the handle slot. A portion of the adjustable handle and/or handle-guide extends through the handle slot to connect the adjustable handle to the cane support. In an exemplary embodiment, the handle-guide comprises an extension that extends out from the guide-channel through the handle slot and comprises threads. The adjustable handle comprises threads that engage with the extension to secure the adjustable handle with the handle-guide. The threads on the adjustable handle may be male or female and engage with corresponding male or female threads on the handle-guide. It may be preferred to have an extension on the handle-guide that extends through the handle slot to facilitate re-attachment of the handle if it is detached from the handle-guide. A stop may be configured on the handle-guide and/or the adjustable handle to prevent the adjustable handle from being completely removed or detached from the handle-guide.

An exemplary massage device comprises a controller that may be configured on the cane support, such as proximal to the base end of the cane support and may comprising a twisting feature or rolling feature for a user to activate the vibration device and massage head and in some cases to adjust an output level of the vibration device, such as low, medium and high. These output levels may refer to the amplitude or frequency of vibration produced or resulting in the massage head. The controller may also be a push button controller, whereby pushing the button can be used to turn on the vibrating device at a first output level, or frequency and subsequent pressing of the button may change the output level or frequency. The button may require a "push and hold" for a threshold time, such as two or three seconds, to turn on or to turn off the vibrating device.

An exemplary massage device comprises a vibration device that may be detachably attached to the cane support. An exemplary vibration device is decoupled from the cane support and is configured in a vibration chamber that comprises a vibration dampening material, such as an elastomer, between the vibration device and the vibration chamber. In an exemplary embodiment, the vibration device is substantially enclosed by the vibration dampening material when at least about 90% or more of the area within the vibration chamber between the vibration device and chamber housing comprises vibration dampening material, or at least about 95% and any range between and including the values provide. A vibration device is considered to be fully enclosed when about 97% or more of the area within the vibration chamber between the vibration device and chamber housing comprises vibration dampening material, such as when only electrical leads extend through the vibration dampening material from the cane support to the vibration device. A vibration dampening may be an elastomeric material, such as silicone, urethane, or rubber that fills the space between the vibration device and the chamber housing. An exemplary elastomeric material may have a hardness of about 80 Shore A or less, or about 60 Shore A or less, or about 40 Shore A or less, about 20 Shore A or less, about 10 Shore A or less, such as about 5 Shore A or more, and any range between and including these values. An exemplary range may be between 5 and 20 Shore A. A softer the elastomeric material may provide more effective dampening.

The vibration chamber comprises an opening to receive and attach one of a plurality of massage heads. The massage head may have threads that are engage with assembly threads of the vibration assembly. The vibration dampening material may extend out from this opening to form a ring, such as an elastomeric lock ring, between the massage head and the vibration assembly. Threading the massage head onto the vibration assembly may compress this elastomeric lock ring to decouple the massage head from the vibration assembly and particularly from the chamber housing, and to lock the massage head to the vibration assembly. The compression of the elastomeric lock ring creates a force that secures the threaded coupling of the massage head thread and assembly threads.

An exemplary vibration device may comprise an Eccentric Rotating Mass vibration motor, or ERM. The electric motor spins the eccentric mass and this creates vibration. An exemplary vibration device may comprise a piezoelectric vibration device.

An exemplary massage device comprises a battery to power the vibration device and this battery, which may be a plurality of batteries configured in a battery pack which may be configured within the cane support. In an exemplary embodiment, the battery is configured within the cane support and proximal the base end and a cover secures the battery within the cane support. The battery may also be configured proximal the head end of the cane support and may be detached by removal of the vibration device. A light may be used to show the battery level of the battery or battery pack.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figures 1, 2, 3:
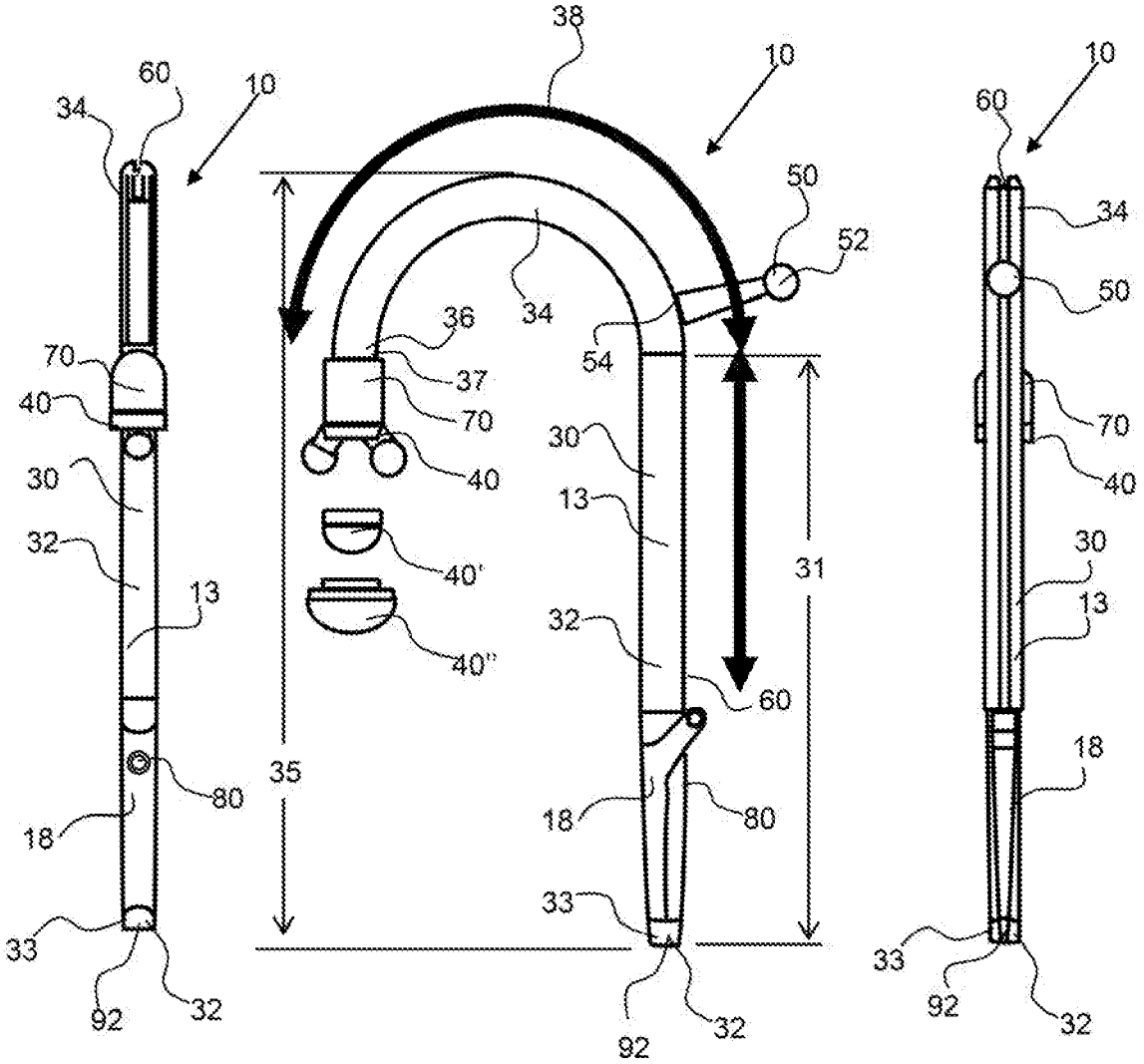
FIG. 1 shows a side view of an exemplary massage device having an adjustable handle and a detachable massage head.
FIG. 2 shows a front view of an exemplary massage device having an adjustable handle.
FIG. 3 shows a back view of an exemplary massage device having an adjustable handle.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

An exemplary vibration dampening material is an elastomeric material that can be deformed and recovery back to an original shape after removal of the deforming force. An exemplary vibration dampening material or elastomeric material is an elastomer, such as silicone, urethane, natural rubber and the like, and may be a foam.

Figure 4:
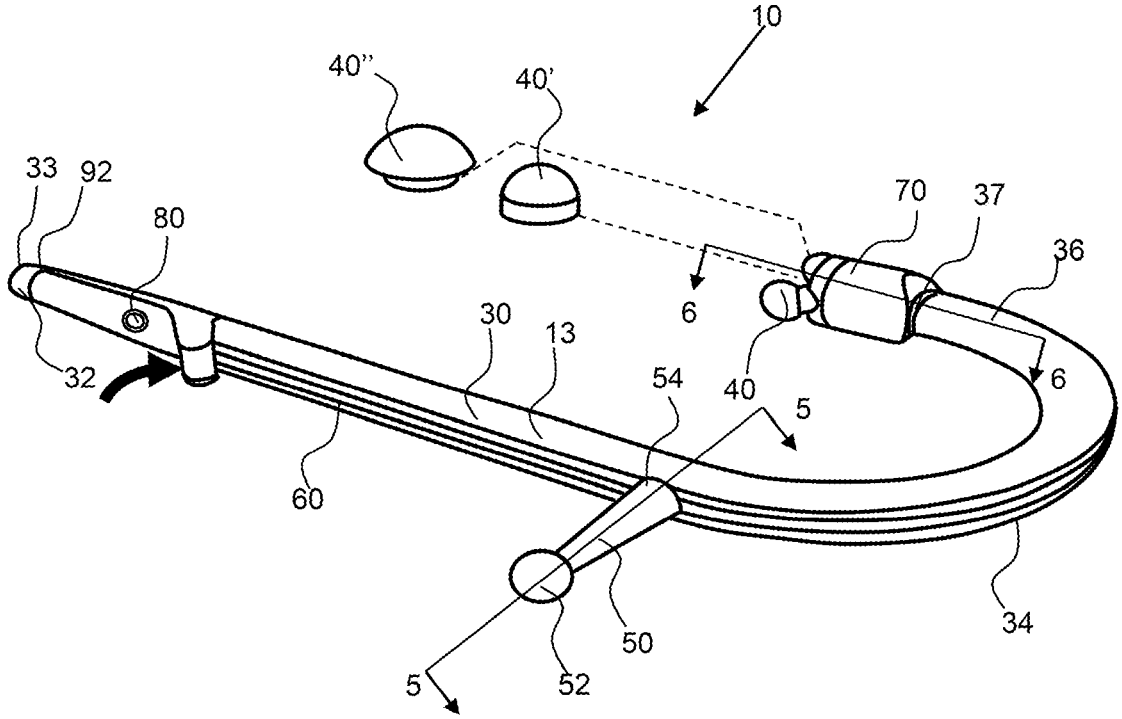
FIG. 4 shows a perspective view of an exemplary massage device having an adjustable handle and detachable massage head.

As shown in FIGS. 1 to 4, an exemplary massage device 10 comprises a cane support 13 extending from a base end 33 to a head end 37 and a massage head 40 coupled to the head end. Note that the cane support may comprise a controller portion 18 on the base end and this controller portion may be attached to the cane support and comprise a handle and a controller 80 for the vibrating device. The exemplary massage device has an adjustable handle 50 that extends out orthogonally from the cane support and is slidably engaged with the cane support, whereby the adjustable handle can be slid to a desired location and then secured in that location by simply twisting the handle. The exemplary massage device has a controller 80 coupled proximal the base end 33 of the cane support, such as in the controller portion 18. The cane support has a support extension 30 that extends linearly from the base end to the arc portion 34 and an arc portion that extends in an arc 38 of that is substantially 180 degrees to the head portion 36. The support extension has a length 31 and the cane support has a length 35 from the base end to the top of the arc portion. The exemplary massage device has a detachably attachable massage head 40 coupled to the vibration device 70. A plurality of massage heads 40 to 40" are shown in FIGS. 1 and 4. A massage head can be detached and replaced with a massage head of choice.

The exemplary cane support has a handle slot 60 to receive the adjustable handle. The slot 60 may extend from the base end 33 to the head end 37; thereby providing a user with a wide range of handle position options. As shown by the bold line along the support extension, the handle slot extends from a position above the controller 80 on the support extension, along the support extension and along the arc portion. The adjustable handle has a length from the handle end 52 to the attached end 54 and may be detachably attachable and may be replaced with a handle having a different geometry, such as length.

The exemplary massage device 10 has batteries 92 to power the vibration device that are coupled with the cane support and may be retained proximal the base end 33, as shown. An electrical connector or wire may extend inside of the cane support 13 to the vibration device 70. A cover 32 on the base end may be removed to remove and re-install batteries. The controller 80 may provide an on/off setting and speed setting or intensity setting for the vibration device 70. A user may simple rotate the controller to turn on the massage head and then turn further to change the speed or intensity of the vibration device, as indicated in FIG. 4 by the bold arrow. The controller may be a sliding type controller, a push button controller and the like.

Figure 5:
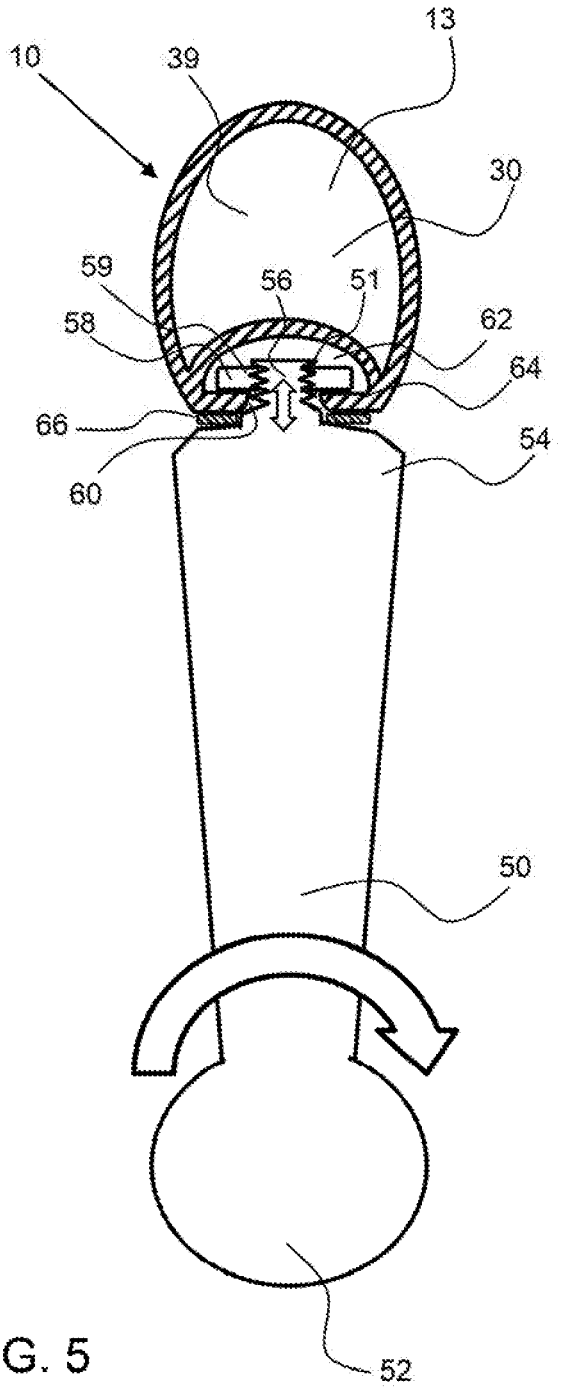
FIG. 5 shows a cross-sectional view of the exemplary massage device shown in FIG. 4 along line 5-5 and shows the adjustable handle connection with the cane support.

As shown in FIG. 5, the adjustable handle 50 is coupled with the cane support 13 by a threaded coupling 56. The threaded coupling comprises threads 59 on the handle-guide 58 and threads 51 on the adjustable handle 50. The handle is rotated, as indicated by the large arrow, to thread the adjustable handle to the handle-guide. Note that the handle-guide may have male or female threads that engage with corresponding male or female threads on the adjustable handle. The handle-guide is configured in the guide-channel 62 of the cane support 13 and slides within the guide-channel to change a position of the adjustable handle. The handle-guide is retained by the inside race 64. The adjustable handle and/or the guide-handle coupling extend through the handle slot 60. A user may rotate the adjustable handle to loosen the handle-guide from the inside race and then slide the adjustable handle to a desired location and rotate the handle to secure it in this new desired location along the handle slot. A retainer gasket 66, which may be an elastic material, may be configured between the adjustable handle and the cane support and may compress when the adjustable handle is rotated to secure it in a fixed position along the handle slot. Note that the cane support has a hollow extension 39 that may extend the entire length of the cane support, wherein the cane support is constructed from an extrusion and subsequently bent to form the arc portion from a linear piece of extrusion. An exemplary cane support is a monolith of metal and this provides high stiffness and prevent breaks at joints.

Figure 6:
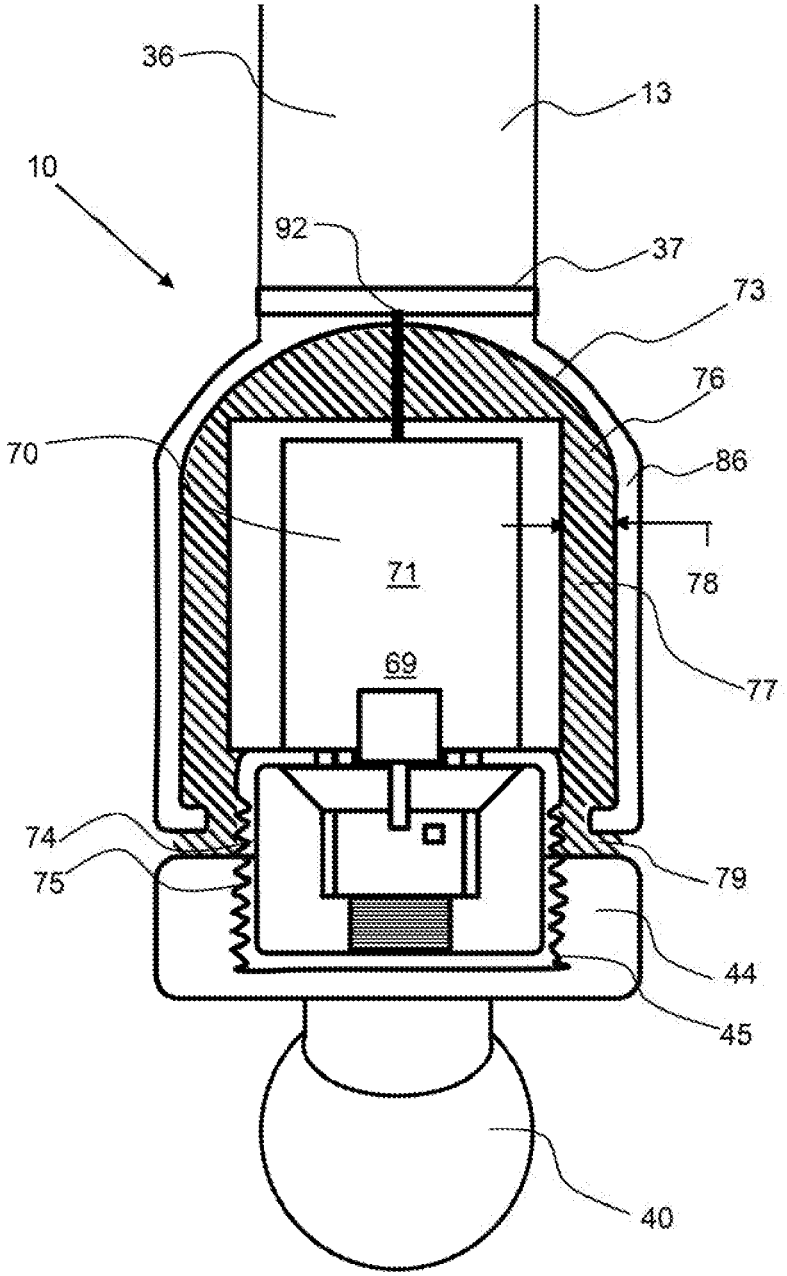
FIG. 6 shows a cross-sectional view of the exemplary massage device shown in FIG. 4 along line 6-6 and shows the vibration device decoupled from the cane support by an elastomeric material extending substantially around the vibration device.

As shown in FIG. 6, the exemplary massage device 10 has a vibration device 70, such as an ERM 71, and/or piezoelectric device 69, decoupled from the cane support 13 by an elastomeric material 77 that extends completely around the vibration device within the vibration chamber 76 of the vibration assembly 73, whereby there is not direct contact of the vibration device with the vibration chamber. The vibration dampening material or elastomeric material 77 has a thickness 78 between the vibration device and the interior wall of the vibration chamber housing 86. The vibration chamber housing 86 extends around the vibration chamber and the elastomeric material. The vibrating assembly has a head coupling 74, which may comprise assembly threads 75, for receiving the massage head 40. The massage head 40 has a cane coupling 44, which may comprise head threads 45 that engage with the assembly threads to secure the massage head to the vibration assembly. Elastomeric material 77 extends out from the vibration chamber 76 to form an elastomeric lock ring 79 between the massage head 40 and the vibration chamber. As the massage head is screwed onto the vibration assembly, the elastomeric lock ring is compressed which effectively secures the massage head to the vibration device and isolates the vibration from the cane support 13. The vibration assembly may be detachably attachable to the cane support. Note that the elastomeric material extends between the vibration device and the cane support and also between the massage head and cane support, except where the electrical connector 92 extends through the elastomer. The electrical connector is not rigid and is flexible and therefore will not transfer any significant vibration to the cane support. The elastomeric material therefore substantially surrounds the vibration device and massage head interface with the cane support, whereby there is not direct coupling or contact of the massage head or the vibration device with the cane support.

Figure 7:
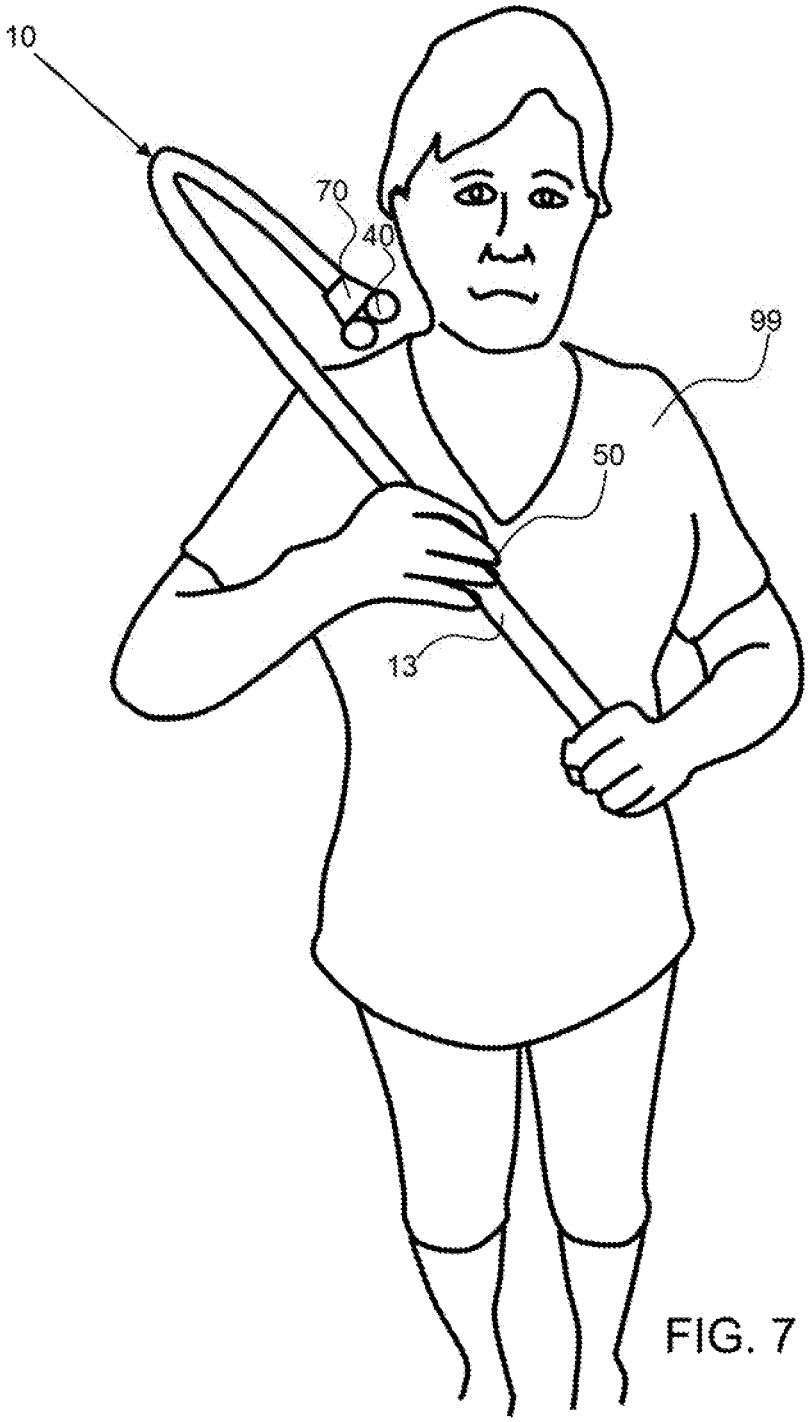
FIG. 7 shows a user holding the massage head of the massage device on their back and holding the adjustable handle to produce more force on the massage head.

As shown in FIG. 7, a user 99 is holding an exemplary massage device with the massage head 40 against their back and holding the adjustable handle 50 to produce more force on the massage head. Because the vibration device 70 is isolated from the cane support 13, as shown in FIG. 6, the user will feel no appreciable vibration in the cane support or adjustable handle.

Figure 8:
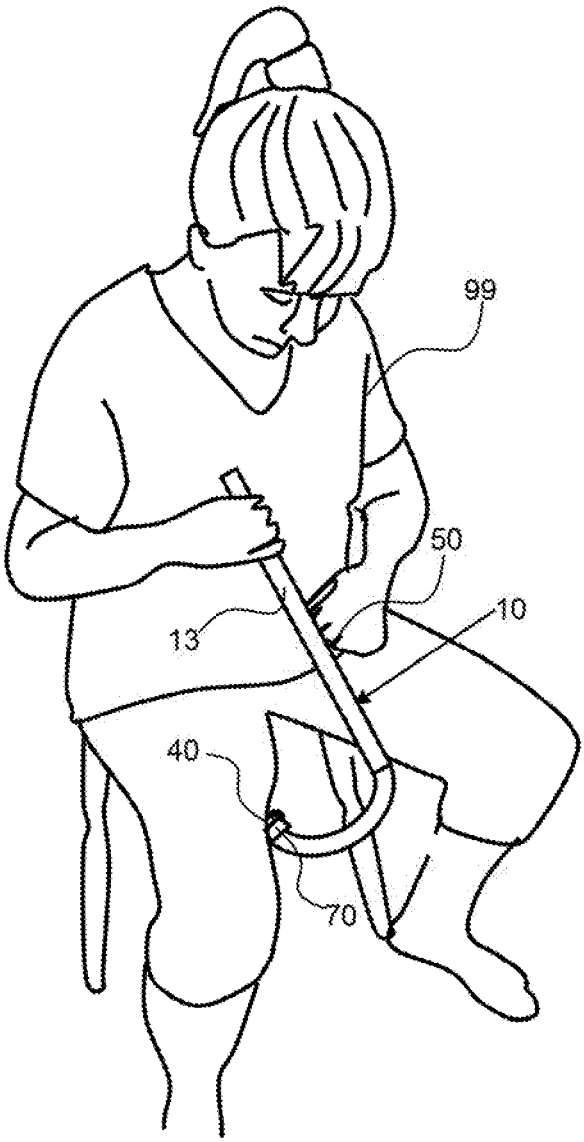
FIG. 8 shows a user holding the massage head of the massage device on their leg and holding the adjustable handle to produce more force on the massage head.

As shown in FIG. 8, a user 99 is holding the massage head 40 of the massage device 10 against their leg and holding the adjustable handle 50 to produce more force on the massage head. Again, because the vibration device 70 is isolated from the cane support 13, the user will feel no appreciable vibration in the cane support or adjustable handle.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A massage device comprising:

a) a cane support extending from a base end to a head end, wherein the cane support comprises:

i) a support extension that extends substantially linearly from the base end, and the support extension comprises a longitudinal axis;

ii) an arc portion that is coupled with the support extension and extends to the head portion; and iii) a handle slot;

iv) a guide-channel configured in and extending along the cane support and coupled with the handle slot;

b) an adjustable handle comprising a longitudinal axis, wherein the longitudinal axis of the adjustable handle is orthogonal to the longitudinal axis of the support extension, and wherein the adjustable handle is slidably engaged with the cane support along the handle slot;

wherein the adjustable handle is detachably attachable to the cane support;

c) a vibration assembly comprising a vibration device coupled with the head end of the cane support;

d) a massage head detachably attached to the vibration device; and e) a controller configured to turn the vibrating device on and adjust an output level of the vibrating device f) a handle-guide slidably located within the guide-channel;

wherein the adjustable handle is coupled to the cane support by said handle-guide having threads that engage with threads on the adjustable handle to create a threaded coupling;

wherein a position of the adjustable handle along the cane support is adjustable; wherein the handle slot extends along at least a portion of the support extension and along at least a portion of the arc portion.

2. The massage device of claim 1, wherein the handle slot extends along the entire arc portion to the head portion.

3. The massage device of claim 1, wherein the handle slot extends from a controller portion configured on a base end to the arc portion and along the entire arc portion to the head end.

4. The massage device of claim 1, wherein the handle-guide comprises threads that engage with threads on the adjustable handle to create a threaded coupling.

5. The massage device of claim 4, wherein the handle-guide comprises female threads that engage with male threads configured on the adjustable handle.

6. The massage device of claim 5, wherein the guide-channel has an inside race that restricts the handle-guide when the adjustable handle is screwed into the handle-guide, thereby retaining the adjustable handle in a fix position along the handle slot.

7. The massage device of claim 1, wherein the vibration device is a vibration motor.

8. The massage device of claim 1, wherein the vibration assembly comprises a vibration chamber housing forming an area for retaining the vibration device, and wherein the vibration device is decoupled from the cane support by an elastomeric material that extends within said area and between the vibration device and the vibration chamber housing.

9. The massage device of claim 8, wherein the elastomeric material extends substantially around the vibration device, wherein at least 90% of the area between the vibration device and the vibration chamber housing comprises said elastomeric material.

10. The massage device of claim 9 wherein the elastomeric material extends between the vibration chamber housing and the massage head to form a lock ring.

11. The massage device of claim 10, wherein the vibration chamber housing has an opening to receive the massage head;

wherein the massage head has a cane coupling comprising head threads and wherein the vibration assembly comprises a head coupling comprising assembly threads; and wherein the massage head is detachably attachable to the vibration assembly by engagement of the head threads with the assembly threads and whereby rotation of the massage head secures the massage head to the vibration assembly with the elastomeric material configured therebetween.

12. The massage device of claim 9, comprising a battery configured within a controller portion of the cane support, wherein the battery is electrically coupled with the vibration device to power the vibration device, and wherein an electrical connector extends from the battery to the vibration device within the cane support.

13. The massage device of claim 1, wherein the cane support is metal and comprises a hollow extension extending along the entire length of the cane support.

14. A massage device comprising:

a) a cane support extending from a base end to a head end, wherein the cane support comprises:

i) a support extension that extends substantially linearly from the base end and the support extension comprises a longitudinal axis;

ii) an arc portion that is coupled with the support extension and extends to the head portion; and iii) a handle slot;

iv) a guide-channel configured in and extending along the cane support and coupled with the handle slot;

b) an adjustable handle comprising a longitudinal axis, wherein the longitudinal axis of the adjustable handle is orthogonal to the longitudinal axis of the support extension, and wherein the adjustable handle is slidably engaged with the cane support along the handle slot;

wherein the adjustable handle is detachably attachable to the cane support;

c) a vibration assembly comprising:

i) a vibration device coupled with the head end of the cane support;

ii) a vibration chamber housing forming an area for retaining the vibration device, iii) an elastomeric material configured within the vibration chamber housing;

wherein the elastomeric material extends substantially around the vibration device in said area between the vibration device and the vibration chamber housing, wherein at least 90% of the area between the vibration device and the vibration chamber housing comprises said elastomeric material, and wherein the vibration device is decoupled from the cane support by said elastomeric material that extends between the vibration device and the vibration chamber housing;

d) a massage head detachably attached to the vibration device; and e) a controller configured to turn the vibrating device on and adjust an output level of the vibrating device, wherein the handle slot extends along at least a portion of the support extension and along at least a portion of the arc portion.

15. The massage device of claim 14, comprising a battery this configured proximal the base end of the cane support and wherein an electrical connector extends from the battery to the vibration device.

16. The massage device of claim 14, wherein the cane support is metal and comprises a hollow extension extending along the entire length of the cane support.

* * * * *